US010040114B2

(12) United States Patent
Laine

(10) Patent No.: US 10,040,114 B2
(45) Date of Patent: Aug. 7, 2018

(54) METHOD FOR PRODUCING AN ARTICLE HAVING A CAVITY

(75) Inventor: Jarkko Ilari Laine, Vaasa (FI)

(73) Assignee: WARTSILA FINLAND OY, Vaasa (FI)

( * ) Notice: Subject to any disclaimer, the term of this patent is extended or adjusted under 35 U.S.C. 154(b) by 1527 days.

(21) Appl. No.: 13/258,900

(22) PCT Filed: Feb. 12, 2010

(86) PCT No.: PCT/FI2010/050095

§ 371 (c)(1),
(2), (4) Date: Sep. 22, 2011

(87) PCT Pub. No.: WO2010/122213

PCT Pub. Date: Oct. 28, 2010

(65) Prior Publication Data

US 2012/0020826 A1 Jan. 26, 2012

(30) Foreign Application Priority Data

Apr. 24, 2009 (FI) ..... 20095457

(51) Int. Cl.

| | |
|---|---|
| ***B22C 9/10*** | (2006.01) |
| ***B22C 7/02*** | (2006.01) |
| ***B22D 29/00*** | (2006.01) |
| ***B22F 5/10*** | (2006.01) |

(52) U.S. Cl.

CPC ..... *B22C 9/10* (2013.01); *B22C 7/02* (2013.01); *B22C 7/023* (2013.01); *B22D 29/001* (2013.01); *B22F 5/10* (2013.01); *B22F 2998/00* (2013.01)

(58) Field of Classification Search

CPC ..... B22D 29/001; B22F 5/10; B22C 9/10
USPC ..... 164/369
See application file for complete search history.

(56) References Cited

U.S. PATENT DOCUMENTS

| | | | | |
|---|---|---|---|---|
| 3,620,781 | A | 11/1971 | Garvie | |
| 5,696,040 | A | 12/1997 | Gregory et al. | |
| 6,395,117 | B1 * | 5/2002 | Takeuchi et al. | 156/89.11 |
| 2006/0243421 | A1 | 11/2006 | Zhang et al. | |

FOREIGN PATENT DOCUMENTS

| | | | |
|---|---|---|---|
| DE | 3539033 | A12 | 10/1986 |
| EP | 0 210 027 | A2 | 1/1987 |
| EP | 466419 | A2 * | 1/1992 |
| EP | 0466419 | A2 | 1/1992 |
| JP | 50017179 | B | 6/1975 |
| JP | 51081727 | A | 7/1976 |
| JP | 61281075 | A | 12/1986 |
| JP | 08 207053 | A | 8/1996 |
| WO | WO 2004014581 | A2 | 2/2004 |

* cited by examiner

*Primary Examiner* — Weiping Zhu
(74) *Attorney, Agent, or Firm* — Muncy, Geissler, Olds & Lowe, P.C.

(57) ABSTRACT

A method for producing an article (1) having a cavity (4), in which method a mould (2) provided with a core (3) is filled with article material, the article material is hardened around the core (3) to form the article (1), and the core (3) is removed from the solidified article (1). The core (3) is made of yttria tetragonal zirconia polycristal material (Y-TZP) or partially stabilized zirconium (PSZ), and after the hardening phase the core (3) is exposed to a steam atmosphere, after which the core (3) is removed from the article (1).

7 Claims, 1 Drawing Sheet

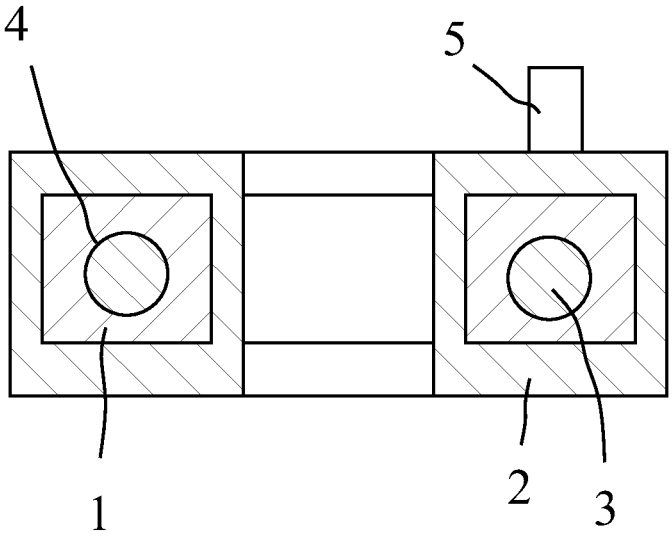
4
5
1
2
3

METHOD FOR PRODUCING AN ARTICLE HAVING A CAVITY

BACKGROUND OF THE INVENTION

Field of the Invention

The present invention relates to a method for producing an article having a cavity.

Brief Description of the Related Art

Precision casting is commonly used to produce castings which have complex hollow interiors. Examples of such cast articles are valve seat inserts for the piston engine which are provided with an internal cooling channel. In order to produce a hollow interior in the cast article, the casting mould must be provided with the core, which is removed from the article after the solidification of the casting material. Especially in precision casting long holes or channels are difficult to make because the existing core materials are either giving poor surface quality or are difficult to remove from the solidified cast article. For example, the core may be removable with acids or other chemical solutions. This increases the costs of the process and chemical substances have their own disadvantages in storage, handling and disposal. Similar core problems exist with other casting methods and isostatic pressing processes.

Document EP 210027 discloses a method for forming a cast article by slip casting through casting a slip into a casting mould. composed mainly of gypsum and removing of the casting mould after solidification of the slip.

SUMMARY OF THE INVENTION

The object of the present invention is to provide a solution by means of which the core can be easily removed from the article.

The objects of the invention are achieved as disclosed in the claims of the present invention.

In the method according to the invention, a mould provided with a core is filled with article material and the material is hardened around the core to form the article. The core is made of yttria tetragonal zirconia polycristal materials (Y-TZP) or partially stabilized zirconium (PSZ). Additionally, after the hardening of the article material the core is exposed to a steam atmosphere after which the core is removed from the article.

Considerable advantages can be achieved by means of the present invention. By subjecting the yttria-tetragonal zirconia polycrystal (Y-TZP) or partially stabilized zirconia material of the core to the steam atmosphere, the material degrades, after which the core can be easily removed from the solidified article. Therefore, no acids or other chemical substances are needed to remove the core from the article. In addition, the surface quality of the cavity interior is typically better than that of articles produced by the conventional methods. Further, the core material used in the invention is chemically inert and resistant to high temperatures.

BRIEF DESCRIPTION OF THE DRAWINGS

In the following, the invention is be described by way of an example with reference to the accompanying FIGURE, which is a cross-sectional view of a hollow valve seat insert in a mould.

DETAILED DESCRIPTION OF THE PREFERRED EMBODIMENTS

The method according to the present invention is directed to method for producing an article 1 having a cavity 4. This kind of the article may be hollow or comprise a complex cavity configuration. The article 1 is produced in a mould 2 in which a core 3 is placed to form the cavity in the article 1. The mould 1 is filled with material of the article and the material is hardened at least partly around the core 3. Thereafter, the core is removed from the solidified article 1.

The article can be, for example, a cooled valve seat insert 1 which is attached to a cylinder head of an internal combustion engine. The valve seat insert 1 is annular and provided with a cavity i.e. an internal cooling channel 4 for coolant.

Additionally, the valve seat insert 1 comprises an inlet port for feeding cooling liquid into the cooling channel 4 and an outlet port for discharging cooling liquid from the cooling channel 4. The article 1 can be produced by casting or isostatic pressing. Suitable casting methods are precision casting, die casting, dead mould casting and sand casting. Correspondingly, suitable isostatic pressing methods are hot isostatic pressing and cold isostatic pressing.

The hollow shape or other complex shape of the article 1 is accomplished by a suitably shaped core 3. The core 3 is shaped to form an internal surface of the article 1. In the embodiment shown in the drawing the core 1 has a shape which corresponds to the shape of the cooling channel 4 in the finished valve seat ring 1.

The core 3 is composed of yttria-tetragonal zirconia polycrystal material(s) ($ZrO_2$—$Y_2O_3$), commonly known as Y-TZP. Y-TZP materials are used in structural applications because of unusual combination of high strength and toughness. Typically Y-TZP is used in dental applications. Another suitable core material is partially stabilized zirconia ($ZrO_2$—MgO), also known as PSZ. Both Y-TZP and PSZ are steam active materials i.e. their microstructures degrade in steam atmosphere. The core 3 can be manufactured by conventional methods suitable for ceramic materials. For example, the core 3 can be shaped as desired and thereafter sintered at an elevated temperature.

The article 1 can be made by precision casting. Precision casting methods are commonly used to produce articles having complex hollow interiors or other complex shapes. In precision casting process a pattern is formed about the core 3. The pattern is composed of wax, polystyrene or other pattern making material having a suitably low melting point. The core 3 is supported by pins made of suitable material. The pins are pushed through the pattern material until they engage the surface of the core 3. Thereafter, a ceramic mould 2 is built around the pattern assembly, i.e. pattern material, the core 3 and the pins. The mould 2 can be formed in a number of ways. Typically, the pattern assembly is repeatedly dipped in ceramic slurry to form the mould 2. After the mould 2 is built up on the pattern assembly, the pattern material is removed from the mould 2. Thereafter, the mould 2 is fired to increase its hardness. The space between the mould 2 and the core 3 is filled with a molten article material, for example metal material such as steel or iron. Molten material is poured into the mould 2 through an inlet channel 5. After hardening of the article material, the mould 2 is removed around the solidified article 1.

Thereafter, the core 3 is removed from the article 1 by exposing the core 3 to steam (water vapour) atmosphere i.e. steam treating the core 3. The core 3 is exposed to steam atmosphere at a temperature of at least 100° C., preferably at least 200° C. Typically, the temperature of the steam atmosphere is between 100 to 500° C., for example between 200 to 300° C. The core 3 is exposed to steam atmosphere for at least 1 hour, preferably for at least 3 hours. The duration of the steam treatment depends on multiple factors, for example the dimensions of the core 3 and the cast article 1 and the properties of the steam atmosphere. The steam treatment of the core 3 can be performed in an autoclave or a similar apparatus, which comprises a chamber for the article to be treated. During the steam treatment process saturated or superheated steam is fed into the chamber. Steam flushes the air out of the chamber. During the treatment steam destroys the core 3 microstructure i.e. degrades core material. After the steam treatment, the article is removed from the chamber. Finally, degraded core 3 is removed from the article 1.

The article 1 can be made by hot isostatic pressing. Hot isostatic pressing (HIP) process subjects the article 1 to both elevated temperature and isostatic pressure. In the HIP-process the core 3 is placed in the mould 2, and thereafter the mould 2 is filled with article material in powder form. Article material can be metal such as steel or iron. Then, the mould 2 is compressed under a uniform (isostatic) pressure at an elevated temperature. The pressure and temperature are such that the powder consolidates or hardens around the core 3. HIP-process as such is well known in the art and therefore is not described here in further detail than necessary to understand the invention. After the isostatic compression, the article 1 is removed from the mould 2. The core 3 is removed from the solidified article 1 by the same steam treating method as described above in connection with the precision casting process.

The invention claimed is:

1. A method for producing an article having a cavity, the method comprising:

providing a mold with a core made of yttria tetragonal zirconia polycristal material (Y-TZP), wherein the core is sintered;

filling the mold with article material;

hardening the article material around the core to form the article;

after the hardening, exposing the core to a steam atmosphere; and after said exposing, removing the core from the article.

2. The method according to claim 1, wherein the core is exposed to a steam atmosphere at a temperature of at least 100° C.

3. The method according to claim 2, wherein the core is exposed to a steam atmosphere at a temperature of at least 200° C.

4. The method according to claim 1, wherein the core is exposed to steam atmosphere for at least 1 hour.

5. The method according to claim 4, wherein the core is exposed to steam atmosphere for at least 3 hours.

6. The method according to claim 1, wherein the mold is filled with molten metal material.

7. The method according to claim 1, wherein the mold is filled with metal powder, which is hardened about the core by isostatic pressing process.

* * * * *